US008985192B2

(12) United States Patent
Mitsuhashi et al.

(10) Patent No.: US 8,985,192 B2
(45) Date of Patent: Mar. 24, 2015

(54) PLATE FIN HEAT EXCHANGER

(75) Inventors: Kenichiro Mitsuhashi, Takasago (JP); Susumu Terada, Takasago (JP); Koji Noishiki, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 1060 days.

(21) Appl. No.: 12/748,860

(22) Filed: Mar. 29, 2010

(65) Prior Publication Data

US 2010/0263823 A1 Oct. 21, 2010

(30) Foreign Application Priority Data

Apr. 20, 2009 (JP) ..... 2009-101964

(51) Int. Cl.

| | |
|---|---|
| ***B60H 1/00*** | (2006.01) |
| ***F28F 11/00*** | (2006.01) |
| ***F28D 7/02*** | (2006.01) |
| ***F28F 3/00*** | (2006.01) |
| ***F28D 9/00*** | (2006.01) |
| ***F28F 3/02*** | (2006.01) |
| ***F28F 27/00*** | (2006.01) |

(52) U.S. Cl.

CPC ..... *F28D 9/0062* (2013.01); *F28D 9/0093* (2013.01); *F28F 3/025* (2013.01); *F28F 27/00* (2013.01)

USPC ..... 165/11.1; 165/70; 165/165; 165/166

(58) Field of Classification Search

CPC ..... F24F 11/00; F24F 11/02; F24F 11/047; F24F 11/053; F24F 2011/001; F28F 3/025; F28F 3/027; F28F 3/08; F28F 3/10; F28F 3/086; F28D 1/0366; F28D 1/0375; F28D 1/0383

USPC ..... 165/11.1, 164, 166, 167, 70

See application file for complete search history.

(56) References Cited

U.S. PATENT DOCUMENTS

| | | | | |
|---|---|---|---|---|
| 3,570,593 | A * | 3/1971 | Isaaz et al. | 165/166 |
| 3,590,914 | A * | 7/1971 | Duncan | 165/166 |
| 3,633,661 | A * | 1/1972 | Duncan et al. | 165/70 |
| 3,825,061 | A * | 7/1974 | Bathla | 165/70 |
| 4,090,554 | A * | 5/1978 | Dickinson | 165/11.1 |
| 4,139,054 | A * | 2/1979 | Anderson | 165/76 |

(Continued)

FOREIGN PATENT DOCUMENTS

JP 7-167580 7/1995

*Primary Examiner* — Allen Flanigan
*Assistant Examiner* — Jason Thompson
(74) *Attorney, Agent, or Firm* — Oblon, McClelland, Maier & Neustadt, L.L.P.

(57) ABSTRACT

A plate fin heat exchanger of the present invention includes a heat exchange part including a heat exchange part main body including layers of plural flow passages, and heat transfer members each of which is disposed within each flow passage of the heat exchange part main body to transfer the heat of fluid flowing in each of the flow passages to each partition walls opposed across the flow passage; and sensing parts connected to both the outsides of the heat exchange part respectively. Each of the sensing parts includes plural sealed spaces, and a sensor wall disposed to separate the outermost sealed space from the sealed space on the inner side thereof. The plate fin heat exchanger further includes a detection means for detecting damage of the sensor wall of the sensing part. According to such a structure, external leak of the fluid performing the heat exchange can be prevented while suppressing deterioration of performance or increase in size or weight.

7 Claims, 5 Drawing Sheets

(56) References Cited

U.S. PATENT DOCUMENTS

| | | | | | |
|---|---|---|---|---|---|
| 4,337,820 | A * | 7/1982 | Pierce | 165/11.1 |
| 4,625,789 | A * | 12/1986 | Chaix et al. | 165/11.1 |
| 6,009,745 | A * | 1/2000 | Shaw et al. | 73/40.7 |
| 6,923,043 | B2 * | 8/2005 | Rabelle | 73/40.5 R |
| 7,152,663 | B2 * | 12/2006 | Helin et al. | 165/11.1 |
| 7,886,580 | B2 * | 2/2011 | Kumar et al. | 73/40.7 |
| 2001/0018962 | A1 * | 9/2001 | Joshi et al. | 165/11.1 |
| 2002/0036078 | A1 * | 3/2002 | Janezich et al. | 165/164 |

* cited by examiner

PLATE FIN HEAT EXCHANGER

BACKGROUND OF THE INVENTION

1. Field of the Invention

The present invention relates to a so-called plate fin heat exchanger which is internally provided with fin plates.

2. Description of the Related Art

As the plate fin heat exchanger (hereinafter also simply referred to as "heat exchanger"), the one described in Japanese Patent Application Laid-Open No. 7-167580 is conventionally known. This heat exchanger includes a heat exchange part including plural flow passages for carrying first fluid and flow passages for carrying second fluid alternately arranged within a casing. Concretely, as shown in FIGS. 4A and 4B, a heat exchange part 100 includes a plurality of partition plates 102 placed in parallel at intervals; corrugated plate-like fin plates 104 each of which is placed between the partition plates 102; and sealing members 106 placed on both sides of the fin plates 104 in their width direction so as to sandwich them, the sealing members 106 sealing the space between the partition plates 102 along the fin plate 104 to form a flow passage r together with the partition plates 102 therein. In order to transfer the heat of a fluid flowing in the flow passage r with the fin plate 104 placed therein to a pair of partition plates 102 with the fin plate 104 therebetween, the plate fin 104 connects the pair of partition plates 102 at specific positions arranged at intervals between one sealing member 106 and the other sealing member 106 (refer to FIG. 4B). In the thus-constituted heat exchange part 100, a number of flow passages r are arranged in layers.

In this heat exchanger, each of two kinds of fluids (e.g., high-temperature fluid and low-temperature fluid) are alternately flowed in each of plural layers of flow passages r arranged in the heat exchange part 100 in order to perform heat exchange between the two kinds of fluids flowing in adjacent flow passages through the partition plate 102. At that time, the fin plate 104 transfers the heat of the fluid flowing between the pair of partition plates 102 with the fin plate 104 therebetween to the pair of partition plates 102, whereby the efficiency of the heat exchange is improved. The thus-constituted heat exchanger is used as heat exchangers for various purposes such as an air separator which requires compactness since it has a relatively simple structure and a high overall heat transfer coefficient.

Protection parts 110 each provided with an internal space r1 are generally disposed on both outsides of the above-mentioned heat exchange part 100 respectively in the arrangement direction of the flow passages r of the heat exchange part 100 (in the vertical direction in FIG. 4B). The protection part 110 is a member provided to protect the flow passage r for carrying the fluid from damage attributed to a contact of the heat exchange part 100 with other members, etc. at the time of the installation or transfer, etc. of the heat exchanger. Namely, even if the heat exchange part 100 is contacted with other members and the outer surface of the heat exchange part 100 dents, the dent occurs only within the range of the protection part 110, and therefore the deformation resulting from the dent is not generated on the partition plates 102 constituting the flow passages r, etc. which are inside the protection part 110. The protection part 110 has the same structure as each flow passage r of the heat exchange part 100.

In the above-mentioned heat exchange part 100, since the sealing member 106 generally has higher rigidity than the fin plate 104, and the fin plate 104 generally has more excellent heat transfer performance than the sealing member 106, the following property to thermal change is higher in the fin plate 104 than in the sealing member 106. Therefore, if the temperature of the fluid flowing in each flow passage r in the heat exchange part 100 suddenly changes, the fin plate 104 deforms more largely than the sealing member 106 in each flow passage r based on this temperature change. Such a difference in the temperature change-based deformation amount between the sealing member 106 and the fin plate 104 causes a stress (thermal stress) based on this difference in deformation amount in a specific site of the heat exchange part 100. Concretely, although the sealing member 106 does not expand so much by a sudden temperature change of the fluid (e.g., 50° C./min, etc.), the fin plate 104 is apt to expand more largely than the sealing member 106. At that time, as shown in FIG. 5, although the space between a pair of partition plates 102 with the flow passage r therebetween is not changed largely in the vicinity of a site where the highly rigid sealing member 106 is disposed, the space is expanded by the expansion of the fin plate 104 in a site distant from the sealing member 106 or in the width-directional center site of the flow passage r. Such deformation of the partition plates 102 causes the deformation-attributed stress (thermal stress) in a specific site of the partition plates 102. This thermal stress generally generates, upon a sudden change in flow rate or temperature in the heat exchange part 100, due to the difference in the deformation amount based on the change in temperature or the like of each member, and such thermal stress attributed to the difference in deformation amount of each member is similarly caused in the specific site not only by the change in temperature or the like of the high-temperature fluid but also by the change in temperature or the like of the low-temperature fluid.

In general, since a number of (e.g., several hundreds) flow passages r are arranged in layers in the heat exchange part 100, the deformation amount from the initial position of the partition plate 102 separating the flow passages r from each other is increased from the center toward the outer side (the upper side and lower side in FIG. 5) in the arrangement direction of the flow passages r. This is attributed to that the deformation amount in each layer (each flow passage) is added from the center toward the outer side as shown in FIG. 5.

Therefore, as in the case where the heat exchanger is used in a chemical plant, for example, the deformation is repeated at each time of sudden change in temperature of the fluid performing the heat exchange or start-stop during the entire period of use, and as a result, the fatigue based on the thermal stress is accumulated most in a specific position of the partition plate 102 which receives the largest deformation amount and separates the protection part 110 from the flow passage r on the inside of the protection part 110, whereby the probability of damage such as hole or cracking in the partition plate 102 becomes high.

If damage such as hole occurs in the partition plate 102 at this position, the fluid flowing in the flow passage r flows into the internal space r1 of the protection part 110. Since the fluid in high-pressure state flows in the flow passage r of the heat exchange part 100 in operation, continuous outflow of the fluid from the flow passage r into the internal space r1 of the protection part 110 can lead to leak of the fluid from the internal space r1 of the protection part 110 to the outside of the heat exchanger due to the gradual increase of pressure within the protection part 110.

Thus, for preventing such leak of the fluid out of the heat exchanger, it has been considered to enhance the rigidity of the fin plate 104 or to suppress the deformation amount of the partition plate 102 between the flow passages r by inserting a reinforcing member into each of the flow passages r to suppress the deformation amount of the partition plate 102 and thereby the accumulation of fatigue.

However, when the rigidity of the fin plate 104 is enhanced in this way, the heat conductivity of the fin plate 104 is reduced, whereby the heat exchange efficiency of the heat exchange part 100 is deteriorated, resulting in deterioration of performance of the heat exchanger. The use of the reinforcing member involves a problem such as increase in size or weight of the device.

SUMMARY OF THE INVENTION

In view of the above-mentioned problems, the present invention thus has an object to provide a plate fin heat exchanger, capable of preventing the external leak of fluids performing heat exchange while suppressing the deterioration of performance or the increase in size or weight.

The present invention provides a plate fin heat exchanger configured to perform heat exchange between plural fluids, comprising: a heat exchange part main body including layers of flow passages for carrying each of the plural fluids arranged with partition walls each of which is arranged between each of two adjacent said flow passages respectively; heat transfer members each of which is disposed within each of said flow passages of said heat exchange part main body respectively, each of said heat transfer member connecting said partition walls opposed across each of said flow passages to transfer the heat of the fluid flowing in each of said flow passages to said opposed partition walls; sensing parts connected to both outer sides of said heat exchange part main body in the arrangement direction of said flow passages respectively, each of said sensing parts including a plurality of sealed spaces arranged in the arrangement direction of said flow passages, and a sensor wall disposed to separate an outermost sealed space of said plural sealed spaces from a sealed space on the inner side of said outermost sealed space; and a detection means for detecting damage of said sensor wall.

According to this configuration, by placing the sensor wall which is free from external leak of fluid even in the event of damage such as hole or cracking in a position where the fatigue by the thermal stress based on the heat of the fluid is accumulated more than in each partition wall of the heat exchange part, accumulation of the thermal stress-based fatigue in each partition wall can be detected by causing the sensor wall to be damaged by the thermal stress prior to each partition wall and detecting this, and repair or the like can be performed before each partition wall is actually damaged by the accumulation of fatigue to cause the external leak of the fluid. Further, by providing the detection means for detecting damage of the sensor wall, the fatigue by the thermal stress based on the heat of the fluid, which is accumulated in each partition wall, can be detected without external leak of the fluid.

Concretely, when a sudden change in temperature or flow rate of fluid occurs, the space between the partition walls opposed across each flow passage is expanded by the thermal expansion of the heat transfer member to deform each partition wall. The deformation amount from the initial position in the outer partition wall in the arrangement direction of the flow passages is larger than that in the central partition wall. This is attributed to that the deformation is repeated in such a manner that a partition wall closer to the center deforms, and a partition wall on the outer side of this deformed partition wall further deforms by the thermal expansion of the heat transfer member disposed between the partition wall and the partition wall closer to the center. Accordingly, the sensing part is provided on the further outer side of the outermost flow passage in the arrangement direction of the flow passages, a plurality of sealed spaces arranged in the same direction as the flow passages is provided in the sensing part, and the sensor wall is provided in a position to separate the sealed spaces from each other, whereby the sensor wall is deformed most seriously based on the thermal stress. Therefore, the sudden change in temperature or the like of the fluid or the start-stop of the heat exchanger is repeated, and the deformation and return to initial position based on the heat of the fluid are consequently repeated, and as a result, the accumulation of the thermal stress-based fatigue is largest in the sensor wall. Thus, by placing the sensor wall in the position with the largest accumulation of the thermal stress-based fatigue in a manner such that no external leak of fluid is generated even if the sensor wall is damaged, and detecting damage such as hole generated in this sensor wall, the accumulation of the thermal stress-based fatigue in each partition wall can be detected before the partition wall is actually damaged.

In the plate fin heat exchanger according to the present invention, the detection means preferably includes a pressurizing means for pressurizing the inside of one of the two sealed spaces with the sensor wall therebetween, and a pressure measuring means for measuring pressure in the other sealed space.

According to this structure, it is possible to accurately detect the presence of even initial damage, or minute hole or cracking generated in the sensor wall by maintaining the pressure in the one sealed space by the pressurizing means and measuring the pressure in the other sealed space by the pressure measuring means while.

Concretely, by maintaining the pressure in the one sealed space at constant level by the pressurizing means, in case of the generation of damage such as hole in the sensor wall, the fluid (e.g., nitrogen gas, etc.) in one sealed space leaks from the one sealed space to the other sealed space through the hole or the like, and the pressure in the other sealed space rises. Therefore, this pressure is measured by the pressure measuring means, whereby the presence of damage of the sensor wall can be detected.

Preferably, the heat exchange part main body includes an outside partition wall which separates an outermost flow passage of the flow passages in the arrangement direction of the flow passages from the outside, and each of the sensing parts is connected to the heat exchange part main body so that an innermost sealed space of the sealed spaces in the arrangement direction of the flow passages is adjacent to the outermost flow passage of the heat exchange part main body with the outside partition wall therebetween, and has strength enough to endure a situation such that the pressure within each of the sealed spaces is equal to the pressure within each of the flow passages with the fluid flowing therein of the heat exchange part main body.

According to this structure, even if the outside partition wall between the heat exchange part main body and the sensing part is damaged during operation of the heat exchanger, and the fluid flows into the sealed space of the sensing part through the damaged part, breakage of the sensing part by the pressure of this fluid can be prevented. Further, since the fluid leaked into the sealed space is confined within the sealed space, the fluid can be prevented from further leaking to the outside.

The heat exchanger preferably includes a fluid detection means for detecting the presence of the fluid in the innermost sealed space of the sealed spaces in the arrangement direction of the flow passages.

According to this structure, even if the fluid flows from the outermost flow passage in the arrangement direction of the flow passages of the heat exchange part into the innermost sealed space of the sensing part during the operation of the heat exchanger, the fluid detection means detects this outflow, whereby the outflow of the fluid from the flow passage can be easily and surely detected. Further, since the fluid leaked to the innermost sealed space is confined within the sealed space, the fluid can be prevented from further leaking to the outside.

Each of the sensing parts preferably has two of the sealed spaces. By providing two sealed spaces in each sensing part, the fatigue by the thermal stress based on the heat of the fluid, which is accumulated in each partition wall, can be detected without external leak of the fluid while suppressing the increase in size and weight of the heat exchanger.

According to the present invention, it is possible to provide a plate fin heat exchanger capable of preventing external leak of fluid performing the heat exchange while suppressing deterioration of performance or increase in size and weight.

BRIEF DESCRIPTION OF THE DRAWINGS

FIG. 4 illustrate a heat exchange part in a conventional heat exchanger, wherein

PREFERRED EMBODIMENTS OF THE PRESENT INVENTION

One preferred embodiment of the present invention will be described in reference to the accompanying drawings.

Figure 1:
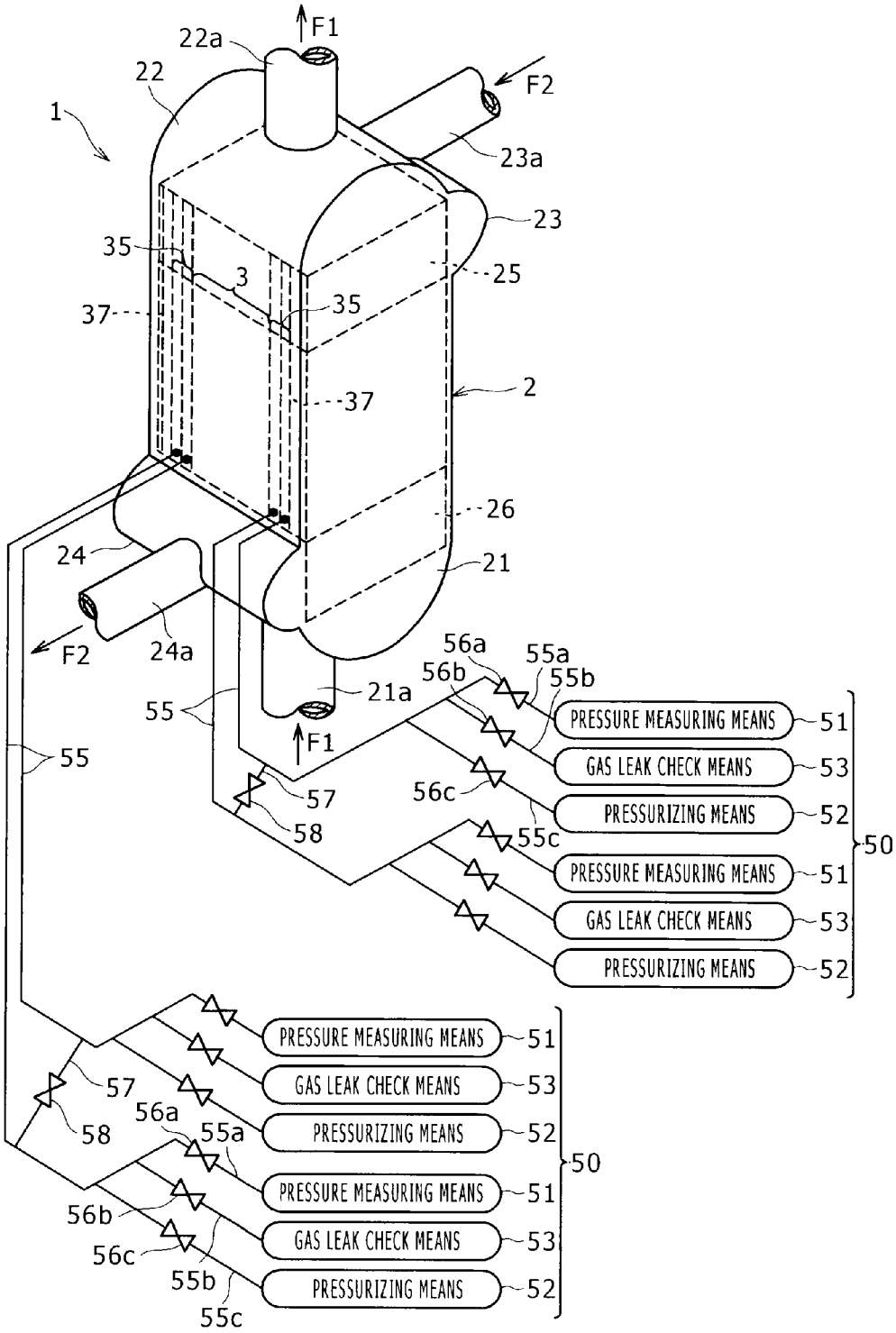
FIG. 1 is a schematic structural view of a plate fin heat exchanger according to one preferred embodiment of the present invention.
Figure 2:
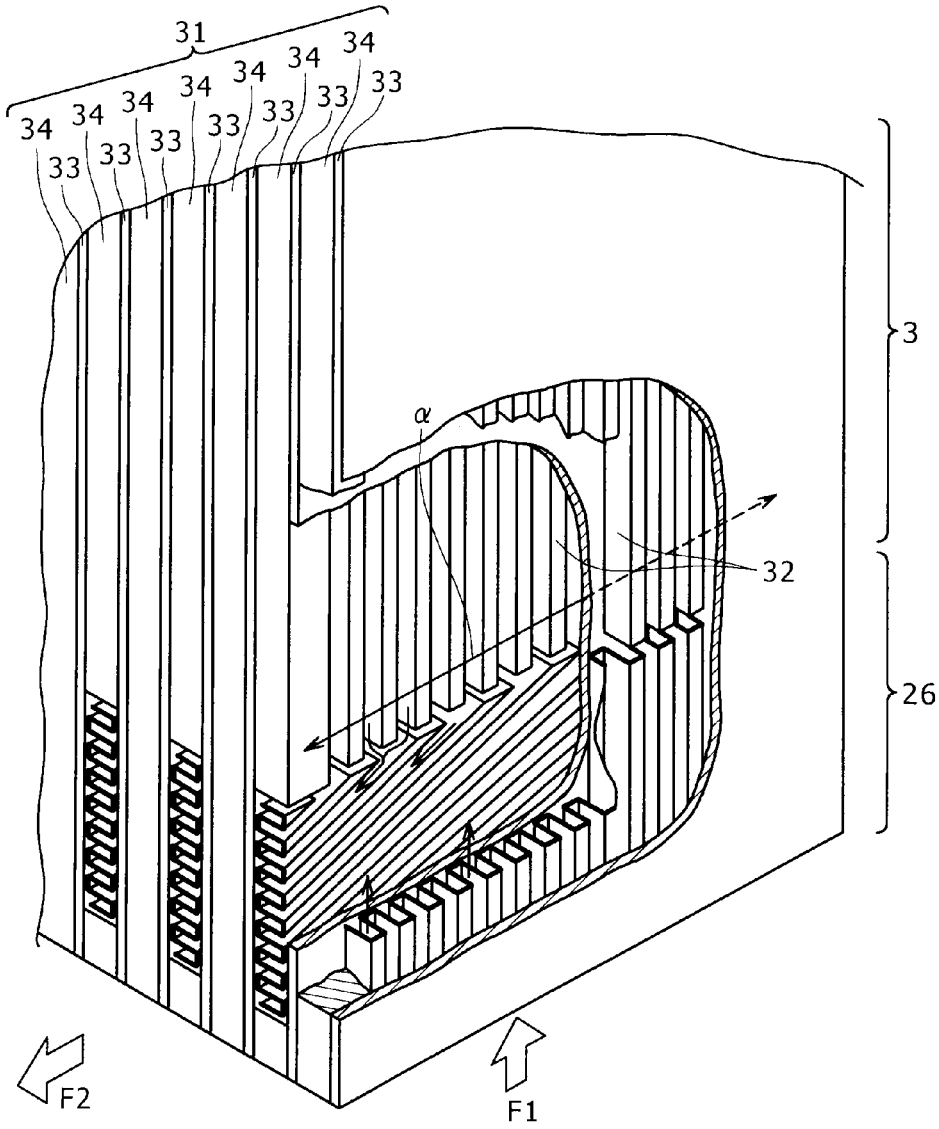
FIG. 2 is a partially enlarged perspective view with partial cutaway of a heat exchange part in the plate fin heat exchanger.
Figure 3:
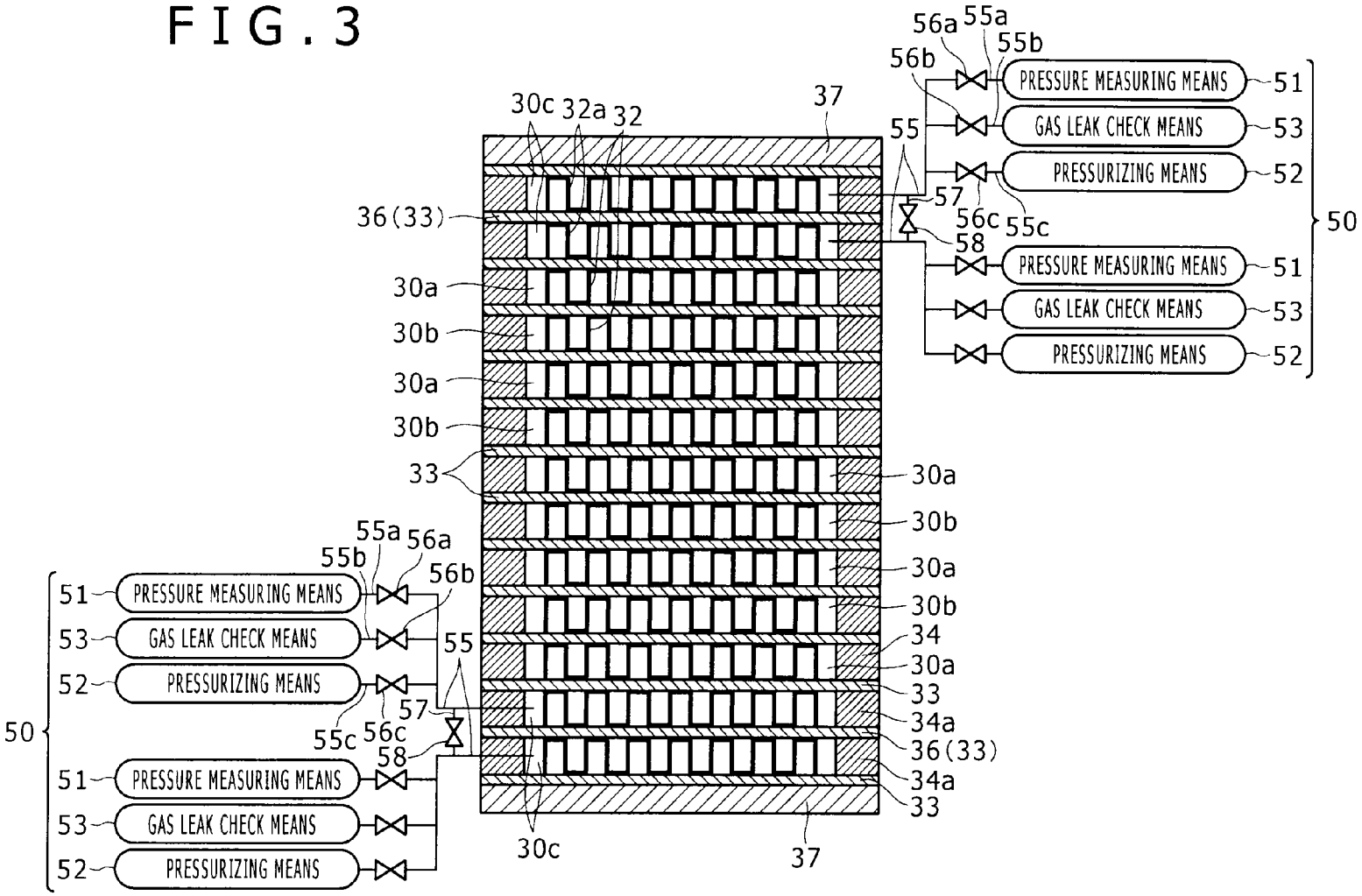
FIG. 3 is a cross-sectional schematic view of the heat exchange part and sensing parts.
Figure 4A:
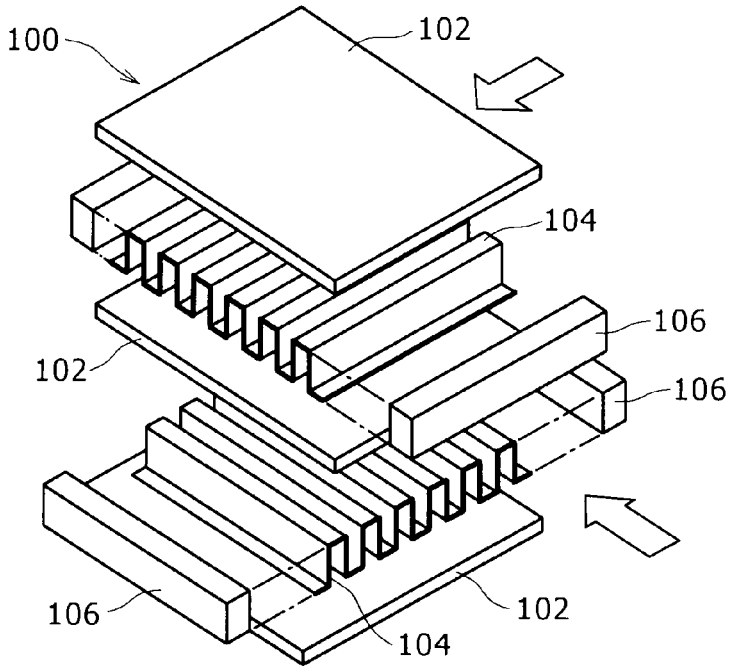
FIG. 4A is an exploded perspective view thereof and FIG. 4B is a front view thereof.
Figure 4B:
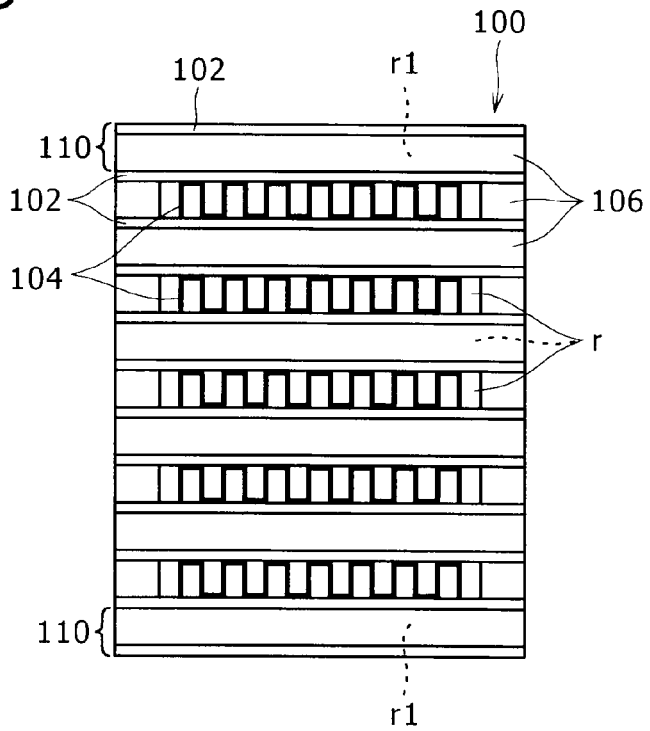

A plate fin heat exchanger (hereinafter also simply referred to as "heat exchanger") according to the present invention is adapted to perform heat exchange between a first fluid and a second fluid both flowing therein. More specifically, as shown in FIGS. 1 to 3, a heat exchanger 1 includes a vertical box-shaped casing 2; and a heat exchange part 3 provided within the center of the casing 2, in which a first flow passage 30*a* for carrying a first fluid F1 and a second flow passage 30*b* for carrying a second fluid F2 are alternately arranged.

The casing 2 includes a bottom header 21 and a top header 22 for the first fluid provided at the bottom and at the top thereof respectively. The casing 2 further includes an upside header 23 and a downside header 24 for the second fluid provided at an upside and a downside portions thereof respectively. A first fluid inlet pipe 21*a* for taking in the first fluid F1 into the heat exchanger 1 is connected to the bottom header 21, and a first fluid outlet pipe 22*a* for discharging the first fluid F1 out of the heat exchanger 1 is connected to the top header 22. A second fluid inlet pipe 23*a* for taking in the second fluid F2 into the heat exchanger 1 is connected to the upside header 23, and a second fluid outlet pipe 24*a* for discharging the second fluid F2 out of the heat exchanger 1 is connected to the downside header 24.

A heat exchange part 3 is disposed at a vertically central portion within the casing 2, and an upper distribution part 25 and a lower distribution part 26 are disposed over and below the heat exchange part 3 respectively. The upper distribution part 25 is an area for guiding the second fluid F2 taken into the upside header 23 from the second fluid inlet pipe 23*a* to each second flow passage 30*b* of the heat exchange part 3 and also guiding the first fluid F1 passed through each first flow passage 30*a* of the heat exchange part 3 to the top header 22. On the other hand, the lower distribution part 26 is an area for guiding the first fluid F1 taken into the bottom header 21 from the first fluid inlet pipe 21*a* to each first flow passage 30*a* of the heat exchange part 3 and also guiding the second fluid F2 passed through each second flow passage 30*b* of the heat exchange part 3 to the downside header 24.

According to such a structure, the first fluid F1 supplied to the heat exchanger 1 is taken from the first fluid inlet pipe 21*a* into each first flow passage 30*a* of the heat exchange part 3 successively through the bottom header 21 and the lower distribution part 26, passed through each first flow passage 30*a*, and then discharged from the first fluid outlet pipe 22*a* successively through the upper distribution part 25 and the top header 22. On the other hand, the second fluid F2 supplied to the heat exchanger 1 is taken from the second fluid inlet pipe 23*a* into each second flow passage 30*b* of the heat exchange part 3 successively through the upside header 23 and the upper distribution part 25, passed through each second flow passage 30*b*, and then discharged from the second fluid outlet pipe 24*a* successively through the lower distribution part 26 and the downside header 24.

The heat exchange part 3 includes a heat exchange part main body 31 in which a number of flow passages 30 (the first flow passages 30*a* and the second flow passages 30*b*) are arranged in layers by alternately placing the first flow passages 30*a* and the second flow passages 30*b*; and a fin plate (heat transfer member) 32 arranged within each of the flow passages 30. The heat exchange part main body 31 includes a plurality of partition plates (partition walls) 33, and a side bar 34 connecting the partition plates 33 to each other. The partition plate 33 is a plate-like member capable of transferring heat between one surface and the other surface thereof, and in this embodiment, a rectangular plate-like member formed of aluminum alloy such as A3003 is adopted. The plurality of partition plates 33 are disposed at intervals and parallel to each other. As materials of the partition plate 33, an aluminum alloy such as A3003 is used in this embodiment as an example, and titanium, copper, stainless steel or the like may be used.

The side bar 34 is a member which connects opposed partition plates 33 of the plurality of partition plates 33 disposed at intervals, and forms the flow passage 30 between the opposed partition plates 33 by sealing the space between the partition plates 33. The side bars 34 are disposed along both sides of the space between each two of the partition plates 33, and extend vertically along the sides of the partition plates 33 while sealing the space between each of the adjacent two of the partition plates 33. As materials of the side bar 34, an aluminum alloy such as A3003 is used in this embodiment as an example, and titanium, copper, stainless steel or the like may be used.

By disposing the partition plates 33 and the side bars 34 in this manner, the flow passage 30 enclosed by a pair of partition plates 33 and a pair of side bars 34 disposed between these partition plates 33 is formed between each two of the partition plates 33. Accordingly, in the heat exchange part 3, a number of flow passages 30 are arranged in layers (refer to FIG. 3). The passages 30 include the first flow passages 30*a* for carrying the first fluid F1 and the second flow passages 30*b* for carrying the second fluid F2. The first flow passage 30*a* and the second flow passage 30*b* have the same structure. In this embodiment, since each of the first fluid F1 and the second fluid F2 are alternately flowed through each of the number of flow passages 30 arranged in layers, the first flow passages 30*a* and second flow passages 30*b* are alternately arranged in the heat exchange part 3.

The fin plate 32 is a member disposed within each flow passage 30 to connect the partition plates 33 opposed across the flow passage 30 and to transfer the heat of the fluid F1 or F2 flowing in the flow passage 30 to the opposed partition plates 33. Namely, the fin plate 32 is a member for improving the heat exchange efficiency of the heat exchange part 3 by ensuring, within each flow passage 30, the contact area with the fluid flowing in the flow passage 30. Concretely, the fin plate 32 is a sheet member repetitively protruded and recessed in the width direction of the flow passage 30 (the direction of arrow α in FIG. 2) so as to alternately contact with the partition plates 33 opposed across the fin plate 32, in other words, a corrugated plate-like member. The thus-constituted fin plate 32 is larger in thermal expansion coefficient than the side bar 34. This difference in thermal expansion coefficient is resulted from the difference in heat capacity or rigidity of each member based on shape, size or the like. As materials of the fin plate 32, an aluminum alloy such as A3003 is used in this embodiment as an example, and titanium, copper, stainless steel or the like may be used.

Sensing parts 35 are connected respectively to both outer sides in the arrangement direction of the flow passages 30 (in the vertical direction in FIG. 3) of the thus-constituted heat exchange part 3. In other words, the sensing parts 35 are connected to the heat exchange part 3 so as to sandwich the heat exchange part 3 from both the outer sides in the arrangement direction of the flow passages 30. Each of the sensing parts 35 includes a sensor plate (sensor wall) 36 which is more easily damaged by the thermal stress based on the heat of the fluid flowing in the flow passage 30 than each partition plate 33 of the heat exchange part 3. Concretely, each sensing part 35 internally has a plurality of (two in this embodiment) sealed spaces 30*c* arranged in the arrangement direction of the flow passages 30, and the sensor plate 36 is disposed so as to separate the outermost sealed space 30*c* in the arrangement direction of the plurality of sealed spaces 30*c* from the sealed space 30*c* on the inner side thereof.

In this embodiment, the sensing part 35 is formed integrally with the heat exchange part 3. Concretely, the sensing part 35 is formed by placing a plurality of (two in this embodiment) partition plates 33 along each both of the outer sides of the heat exchange part 3 in the arrangement direction of the flow passages 30 in parallel and at intervals, and sealing the entire circumference of the space between each two of the partition plates 33 including the same fin plate 32*a* as in the heat exchange part 3 therein with side bars 34*a*. In the sensing part 35, the sealed space 30*c* is formed between a pair of partition plates 33 by sealing the entire circumference of the pair of partition plates 33 with the side bars 34*a*. The second outermost partition plate 33 in the arrangement direction of the flow passages 30 constitutes the sensor plate 36. Namely, since the degree of accumulation of the fatigue by the thermal stress based on the heat of the fluid F1 or F2 is differed among the plurality of partition plates 33 arranged in parallel depending on the arrangement position thereof, and the accumulation of the fatigue is largest in the second outermost partition plate 33 in this embodiment, the partition plate 33 of this position is taken as the sensor plate 36. This is attributed to that the deformation amount from the initial position of the partition plate 33 based on the difference in thermal expansion coefficient between the fin plate 32 and the side bar 34 is increased toward the outer side in the arrangement direction of the flow passages 30.

In this embodiment, the same plate is used for the partition plate 33 of the sensing part 35 and the partition plate 33 of the heat exchange part 3, and the same plate is used for the fin plate 32*a* of the sensing part 35 and the fin plate 32 of the heat exchange part 3. The side bar 34*a* of the sensing part 35 and the side bar 34 of the heat exchange part 3 are formed of the same material. Therefore, the sensing part 35 has strength enough to endure a situation such that the pressure in the sealed space 30*c* is equal to the pressure in the flow passage 30 with the high pressure fluid F1 or F2 in the heat exchange part 3 flowing therein.

An outside sheet 37 for protecting the heat exchange part 3 and the sensing part 35 is provided on the outside of the sensing part 35.

A detection means 50 for detecting damage of the sensor plate 36 is provided for each sensing part 35 constituted as above. The detection means 50 includes a pressure measuring means 51, a pressurizing means 52, and a gas leak check means (fluid detection means) 53. As the pressure measuring means 51 for measuring pressure within each sealed space 30*c*, a pressure gauge is used in this embodiment. The pressurizing means 52 for pressurizing the inside of each sealed space 30*c* is configured to pressurize the inside of the sealed space 30*c* by feeding nitrogen gas into the sealed space 30*c* in this embodiment. The gas leak check means 53 checks the presence of the fluid F1 or F2 in each sealed space 30*c*.

Concretely, pipes 55 connecting with the respective sealed spaces 30*c* are connected to each sensing part 35, and each of the pipes 55 is branched to three branch pipes (a first branch pipe 55*a*, a second branch pipe 55*b*, and a third branch pipe 55*c*). The branch pipes 55*a* to 55*c* are provided with valves 56*a* to 56*c* respectively, the pressure measuring means 51 is connected to the first branch pipe 55*a*, the gas leak check means 53 is connected to the second branch pipe 55*b*, and the pressurizing means 52 is connected to the third branch pipe 55*c*. The pipe 55 communicating with the outer sealed space 30*c* in the arrangement direction of the flow passages 30 is communicated with the pipe 55 communicating with the sealed space 30*c* on the inner side thereof through a connecting pipe 57, and the connecting pipe 57 is provided with a valve 58.

In the heat exchanger 1 constituted as above, heat exchange is performed between the first fluid F1 (natural gas based on methane of 40° C. in this embodiment) and the second fluid F2 (natural gas based on methane of −40° C. in this embodiment) by starting the heat exchanger 1, taking the first fluid F1 from the first fluid inlet pipe 21*a* into the heat exchanger 1, and also taking the second fluid F2 from the second fluid inlet pipe 23*a* into the heat exchanger 1. Specific fluids and temperature used in the heat exchange through the heat exchanger 1 are never limited to the above-mentioned gases or temperatures.

Concretely, upon start-up of the heat exchanger 1, the first fluid F1 guided from the first fluid inlet pipe 21*a* into the heat exchange part 3 through the bottom header 21 and the lower distribution part 26, and the second fluid F2 guided from the second fluid inlet pipe 23*a* into the heat exchange part 3 through the upside header 23 and the upper distribution part 25 flow in mutually opposed directions through each partition plate 33 (upwardly for the first fluid F1 and downwardly for the second fluid F2 in FIG. 1) in the heat exchange part 3. The first fluid F1 and the second fluid F2 flow in the respective flow passages 30 of the heat exchange part 3 in this way, whereby the first fluid F1 and the second fluid F2 perform heat exchange through the partition plate 33 and the fin plate 32 disposed within each flow passage 30 and in contact with the partition plate 33.

After operation of the heat exchanger 1 for a predetermined time, the supply of the first fluid F1 and second fluid F2 is stopped, and the heat exchanger 1 is also stopped. The heat exchanger 1 repeats start and stop in this way.

A sudden change in temperature or flow rate often occurs in the first fluid F1 or the second fluid F2 flowing in each flow passage 30 of the heat exchange part 3 during operation of the heat exchanger 1. This sudden change in temperature or flow rate can occur at times other than the start or stop of the heat exchanger 1. In such a case, the partition plate 33, the fin plate 32 and the side bar 34 which are in contact with the first fluid F1 or second fluid F2 suddenly changed in temperature or flow rate are thermally expanded. The deformation amount based on the thermal expansion is differed among the partition plate 33, the fin plate 32 and the side bar 34 since each member has a different coefficient of thermal expansion. Concretely, since the fin plate 32 is larger in the coefficient of thermal expansion than the side bar 34 as described above, the partition plates 33 with each flow passage 30 therebetween are deformed by the fin plate 32 arranged therebetween. In more detail, the side bar 34 does not expand so much by the heat of the fluid F1 or F2, while the fin plate 32 is apt to expand more than the side bar 34 by the heat of the fluid F1 or F2. Therefore, the space between a pair of partition plates 33 with each flow passage 30 therebetween is not so much changed by the thermal expansion of the fin plate 32 at the sides of the partition plate 33 where the side bars 34 are disposed, but the space is broadened at an area distant from the side bars 34, or at the center in the width direction of the flow passages 30. Upon such deformation of the partition plate 33, a stress (thermal stress) resulting from the deformation is caused at a specific site (concretely, in the vicinity of the side bars 34) of the partition plate 33.

Figure 5:
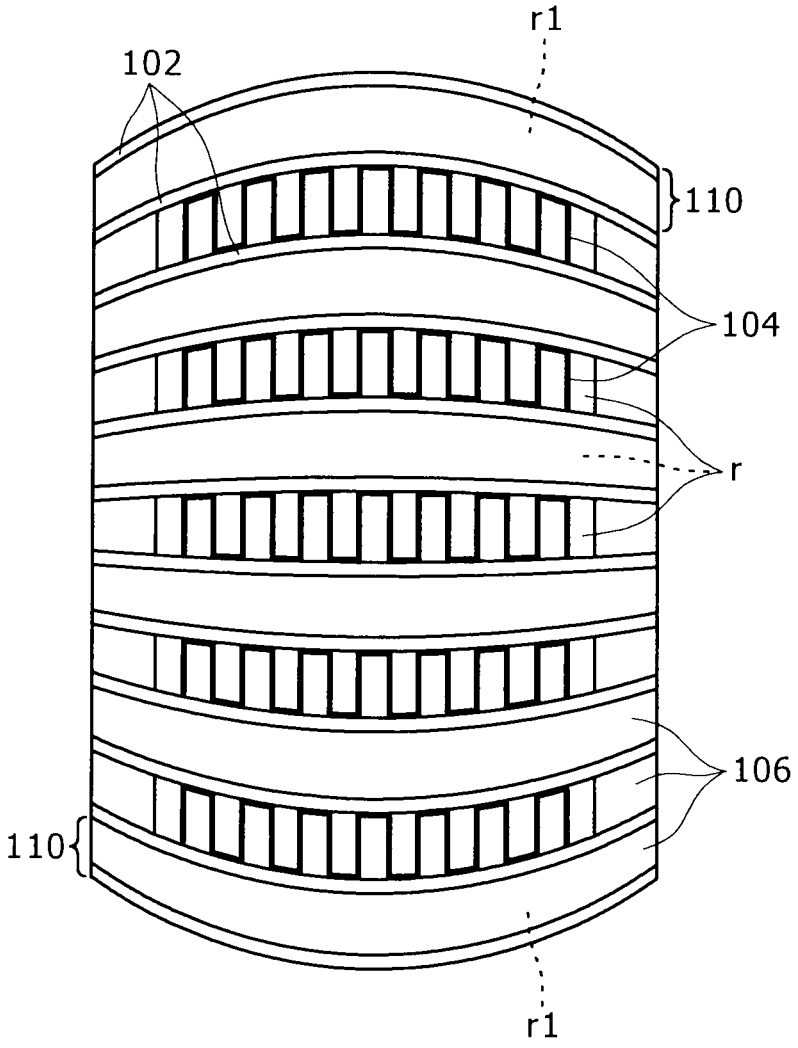
FIG. 5 is a typical view showing a thermally expanded state of the conventional heat exchange part.

Since a number of (e.g., several hundreds) flow passages 30 are arranged in layers in the heat exchange part 3 in this embodiment, the deformation amount from the initial position of the partition plate 33 separating the flow passages 30 from each other increases from the center part toward the outer side (the upper side or lower side in FIG. 3) (e.g., refer to FIG. 5). This is attributed to that the deformation amount in each flow passage 30 is added from the center part toward the outer side. Namely, the deformation is repeated in such a manner that a partition plate 33 on the center side is deformed, and a partition plate 33 on the outer side of this deformed partition plate 33 is further deformed by the thermal expansion of the fin plate 32 disposed between the partition plate 33 and the partition plate 33 on the center side. Accordingly, the outer partition plate 33 in the arrangement direction of the flow passages 30 has the larger deformation amount.

The partition plate 33 returns from the deformed state to a flat state (initial position) when the distribution of the fluids F1 and F2 within the flow passages 30 is stopped, for example, by stop of the heat exchanger 1, since the thermally-expanded fin plate 32 contracts to its original state.

In this way, the above-mentioned expansion and contraction are repeated at such sudden changes in temperature or flow rate of the fluid F1 or F2 distributed within the heat change part 3 as the repeated start and stop during the entire period of use of the heat exchanger 1. And as a result, at the outer partition plate 33 with the largest deformation amount, more fatigue based on the thermal stress is accumulated in the above specific site, whereby the probability of damage such as hole or cracking in the partition plate 33 becomes high.

In the heat exchanger 1 of this embodiment, therefore, the sensing part 35 provided with the sensor plate 36 is provided on each outer side of the heat exchange part 3, and the detection means 50 for detecting damage of the sensor plate 36 is provided to detect the damage, whereby the fatigue by the thermal stress based on the heat of the fluid, which is accumulated in each partition plate 33, can be detected without external leak of the fluid F1 or F2.

Namely, the sensor plate 36 which is free from external leak of the fluid F1 or F2 even at the occurrence of hole or cracking etc. is disposed in a position where the fatigue by the thermal stress based on the heat of the first fluid F1 is accumulated more than in each partition plate 33 of the heat exchange part 3 (or an outside position in the arrangement direction), whereby the accumulation of the fatigue based on thermal stress in each partition plate 33 can be detected by causing the sensor plate 36 to be damaged by the thermal stress prior to each partition plate 33, and detecting this, and repair or the like can be performed before each partition plate 33 is actually damaged by the accumulation of the fatigue to cause the external leak of the fluid F1 or F2.

The damage detection of the sensor plate 36 is performed as described below.

The valve 56*a* of the first branch pipe 55*a* of the pipe 55 communicating with the sealed space 30*c* on the outer side in the arrangement direction of the flow passages 30 is opened, and the valve 56*c* of the third branch pipe 55*c* of the pipe 55 communicating with the closed space 30*c* on the inner side of the sealed space 30*c* is opened. In this state, the pressure in the outer sealed space 30*c* is measured by the pressure measuring means 51 connected to this outer sealed space 30*c* while pressurizing the inner sealed space 30*c* by injecting nitrogen gas thereto by the pressurizing means 52 connected to this inner sealed space 30*c*. Since the pressure in the outer sealed space 30*c* rises if damage such as hole or cracking occurs in the sensor plate 36 separating the outer sealed space 30*c* from the inner sealed space 30*c*, the damage can be detected. Namely, if the damage such as hole occurs in the sensor plate 36, the pressure within the outer sealed space 30*c* rises since the nitrogen gas filled in the inner closed space 30*c* leaks from the inner sealed space 30*c* to the outer sealed space 30*c* through the hole or the like. Therefore, this change in pressure is detected by the pressure measuring means 51 connected to the outer sealed spaced 30*c*, whereby the presence of the damage of the sensor plate 36 can be detected.

Such damage detection of the sensor plate 36 may be regularly or periodically performed. The damage detection of the sensor plate 36 can be performed otherwise by measuring the pressure in the inner sealed space while maintaining the pressure in the outer sealed space 30*c* by pressurization.

The valve 56*b* of the second branch pipe 55*b* communicating with the inner sealed space 30*c* in the arrangement direction of the flow passages 30 is opened during operation of the heat exchanger 1, whereby damage of the partition plate 33 separating the inner sealed space 30*c* from the flow passage 30 of the heat exchange part 3 can be detected. Concretely, if damage such as hole occurs in this partition plate 33, the fluid F1 or F2 flows from the flow passage 30 into the inner sealed space 30*c* through the hole or the like. Therefore, the damage of the partition plate 33 can be detected based on leak of the fluid F1 or F2 by analyzing the component of the gas in the inner sealed space 30*c* by the gas leak check means 53 connected to the inner sealed space 30*c*.

Further, the valve 56*b* of the second branch pipe 55*b* communicating with the outer sealed space 30*c* is opened, whereby damage of the partition plate 33 separating the inner sealed space 30*c* from the outer sealed space 30*c* (the sensor plate 36) can be also detected in addition to damage of the partition plate 33 separating the flow passage 30 from the inner sealed space 30*c*. Namely, the fluid F1 or F2 reaches from the heat exchange part 3 to the outer sealed space 30*c* only when both the partition plates 33 are damaged. Therefore, the damage of both the partition plates 33 can be detected by analyzing the gas in the outer sealed space 30*c* to check whether the component of the fluid F1 or F2 is contained therein.

Further, the valve 56*a* of the first branch pipe 55*a* communicating with the inner sealed space 30*c* is opened during operation of the heat exchanger 1, whereby the presence of damage of the partition plate 33 separating the flow passage 30 of the heat exchange part 3 from the inner sealed space 30*c* of the sensing part 35 can be detected. Concretely, if damage occurs in this partition plate 33, the fluid F1 or F2 flows into the inner sealed space 30*c*, and the pressure in the inner sealed space 30*c* rises. Therefore, this pressure rise is detected by the pressure measuring means 51 connected to the inner sealed space 30*c*, whereby the occurrence of the damage of the partition plate 33 can be detected.

The plate fin heat exchanger 1 of the present invention is never limited to the above-mentioned embodiment, and various changes or modifications can be performed without departing from the gist of the present invention.

Although two sealed spaces 30*c* are provided within each sensing part 35 in the above-mentioned embodiment, three or more sealed spaces may be provided without limitation. However, by providing two sealed spaces 30*c* in each sensing part 35, the fatigue by the thermal stress based on the heat of the fluid F1, which is accumulated in each partition plate 33, can be detected without external leak of the fluid F1 or F2 while suppressing the increase in size and weight of the heat exchanger 1.

In the detection means 50 in this embodiment, the pressure measuring means 51, the pressurizing means 52 and the gas leak check means 53 are connected to each sealed space 30*c* of the sensing part 35 through the pipe 55. However, the connection is not limited to this embodiment. In the detection means 50, at least the pressurizing means 52 is connected to one of the two sealed spaces 30*c* with the sensor plate 36 therebetween to pressurize the inside of the one sealed space 30*c*, and at least the pressure measuring means 51 is connected to the other sealed space 30*c* to measure the pressure in the other sealed space 30*c*.

The detection means 50 may not include the gas leak check means 53. Namely, the gas leak check means 53 may be provided independently from the detection means 50. In this case, the gas leak detection means 53 may be connected to the innermost sealed space 30*c* in the arrangement direction of the flow passages 30. By connecting the gas leak check means 53 in this way, even if damage such as hole occurs in the partition plate 33 between the heat exchange part 3 and the detection part 35 at the start (during operation) of the heat exchanger 1 to cause outflow of the fluid F1 or F2 into the sealed space 30*c* of the sensing part 35 through the damaged portion, the gas leak check means 53 can detect this. Therefore, the outflow of the fluid F1 or F2 from the flow passage 30 can be easily and surely detected. Further, since the fluid leaked into the sealed space 30*c* is confined within the sealed space 30*c*, the fluid can be prevented from leaking to the outside. Further, since the sensing part 35 has the strength equal to that of the heat exchange part 3, it is possible to prevent the damage or the like of the sensing part 35 by the pressure of the fluid F1 or F2 leaked from the flow passage 30 of the heat exchange part 3 to the sealed space 30*c* of the sensing part 35.

The heat exchange part 3 in this embodiment is configured so that two kinds of fluids F1 and F2 perform heat exchange while flowing in opposite directions. The heat exchange part 3 may be configured also so that the two kinds of fluids F1 and F2 flow in the same direction, or flow while crossing each other. In the heat exchanger part 3, flow passages of F1 and flow passages of F2 may be arranged not alternatively. Namely, there are no limitations in arrangement of the flow passages of the two kinds of fluid. Further, the heat exchange part 3 may be configured also so that heat exchange is performed between three or more kinds of fluid. Also in this case, there are no limitations in arrangement of the flow passages of the three or more kinds of fluid. In any of the heat exchange part 3 explained above, the fatigue based on the thermal stress is likely to accumulate in the outer partition plate 33 in the arrangement direction of the flow passages 30 due to the thermal expansion, when a number of flow passages 30 are arranged in layers, and the fin plate 32 is disposed in each flow passage 30. Therefore, by providing the sensing part 35 and the detection means 50 therein, the same effect as in this embodiment can be attained, or the fatigue by the thermal stress based on the heat of the fluid, which is accumulated in each partition wall, can be detected without external leak of the fluid.

What is claimed is:

1. A plate fin heat exchanger configured to perform heat exchange between plural fluids, comprising:

a heat exchange part main body including alternating layers of flow passages for carrying each of the plural fluids, the heat exchange main body includes partition walls each of which is arranged between each of two adjacent said flow passages respectively, the heat exchange part main body includes at least a first outer side and a second outer side, the second outer side provided on an opposite side of the main body from the first outer side, the flow passages are alternately arranged in an arrangement direction from the first outer side to the second outer side such that an axis of the main body part would extend through each alternating layer of the flow passages;

a plurality of side bars positioned between each opposed partition wall to thereby connect the opposed partition walls to each other and seal a space between the opposed partition walls;

heat transfer members each of which is disposed within each of said flow passages of said heat exchange part main body respectively, each of said heat transfer members connecting said partition walls opposed across each of said flow passages to transfer the heat of the fluid flowing in each of said flow passages to said opposed partition walls;

sensing parts including a first sensing part connected to the first outer side and a second sensing part connected to the second outer side of said heat exchange part main body in series along the arrangement direction of said flow passages, each of said sensing parts includes a plurality of sealed spaces including an outermost sealed space and an innermost sealed space provided immediately adjacent the outermost sealed space, the sealed spaces each being formed by a plurality of the opposed partition walls, one of the plurality of side bars, and one of the heat transfer members so as to seal an entire circumference of the sealed spaces, the sealed spaces being arranged in series along the arrangement direction of said flow passages, and a sensor wall disposed to separate the outermost sealed space from the innermost sealed space on the inner side of said outermost sealed space; and a detection means connected to each sensing part for detecting damage of said sensor wall, wherein the first sensing part is provided adjacent the first outer side, and the second sensing part is provided adjacent the second outer side.

2. The plate fin heat exchanger according to claim 1, wherein said detection means includes a pressurizing means for pressurizing the inside of one of said two sealed spaces with said sensor wall therebetween, and a pressure measuring means for measuring pressure in the other sealed space.

3. The plate fin heat exchanger according to claim 1, wherein said heat exchange part main body includes an outside partition wall which separates an outermost flow passage of said flow passages in the arrangement direction of said flow passages from the outside, and each of said sensing parts is connected to said heat exchange part main body so that an innermost sealed space of said sealed spaces in the arrangement direction of said flow passages is adjacent to said outermost flow passage of said heat exchange part main body with said outside partition wall therebetween, and has strength enough to endure a situation such that the pressure within each of said sealed spaces is equal to the pressure within each of said flow passages with the fluid flowing therein of said heat exchange part main body.

4. The plate fin heat exchanger according to claim 1, further comprising:

a fluid detection means for detecting the presence of the fluid in said innermost sealed space of said sealed spaces in the arrangement direction of said flow passages.

5. The plate fin heat exchanger according to claim 1, wherein each of said sensing parts has two of said sealed spaces.

6. The plate fin heat exchanger according to claim 2, wherein the pressurizing means pressurizes the inside of each of the sealed spaces by feeding nitrogen gas into the sealed spaces.

7. The plate fin heat exchanger according to claim 1, wherein a detection means is provided for each of the sensing parts.

* * * * *